US006280108B1

(12) United States Patent
Haining et al.

(10) Patent No.: US 6,280,108 B1
(45) **Date of Patent: *Aug. 28, 2001**

(54) SUNTAN LOTION APPLICATOR

(76) Inventors: John B. Haining, 831 Sunset Dr., Vista, CA (US) 92083-6825; Chin Yi Tu, 127 Calle Huerto, Vista, CA (US) 92084; Kevin Simmons, 1042 Cypress Ave., San Diego, CA (US) 92103

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/221,488

(22) Filed: Dec. 24, 1998

(51) Int. Cl.[7] ..... A61M 35/00

(52) U.S. Cl. ..... 401/6; 401/124; 401/125; 401/130

(58) Field of Search ..... 401/123–125, 401/130, 6, 207

(56) References Cited

U.S. PATENT DOCUMENTS

| | | | | |
|---|---|---|---|---|
| D. 394,915 | | 6/1998 | Haining | D28/7 |
| 2,168,179 | * | 8/1939 | Tobey | 401/130 |
| 2,567,764 | * | 9/1951 | Davies | 401/207 |
| 2,724,849 | * | 11/1955 | Schultz | 401/123 |
| 2,986,762 | * | 6/1961 | Webb | 401/6 |
| 3,590,414 | * | 7/1971 | Gores | 15/110 |
| 4,630,954 | * | 12/1986 | Ladd, Jr. | 401/6 |
| 4,974,984 | * | 12/1990 | Kafkis et al. | 401/269 |
| 5,322,382 | * | 6/1994 | Hull et al. | 401/207 |
| 5,568,669 | | 10/1996 | Godown | 15/143.1 |
| 5,664,281 | | 9/1997 | Pelfrey | 15/244.2 |

FOREIGN PATENT DOCUMENTS

| | | | | |
|---|---|---|---|---|
| 449869 | * | 4/1969 | (CH) | 401/130 |

* cited by examiner

*Primary Examiner*—Charles R. Eloshway
(74) *Attorney, Agent, or Firm*—John R. Ross; John R. Ross, III

(57) ABSTRACT

A lotion applicator that has a hollow handle for containing lotion. The hollow handle has a closable opening and flexible walls such that the squeezing of the walls forces lotion contained within the hollow handle to exit the closable opening. A casing is attached to the handle and covers the closable opening. A casing cap is removably attached to the casing such that a storage compartment is formed by the attachment of the casing cap to the casing. A porous pad is contained within the storage compartment and is for absorbing lotion squeezed out of the handle. Some purposes of the casing cap are to delay drying of the pad, protect the pad from contamination, and prevent lotion on the pad from contaminating other objects. In a preferred embodiment, the user first removes the casing cap from the casing. Then, the user removes the handle from the casing. The user then opens the closable opening and squeezes the handle so that lotion exits the handle and is applied to the pad. The user then reattaches the handle to the casing. Now the user is able to apply lotion to his back and other parts of the body by gripping the handle and rubbing the pad over his body. When complete, the user reattaches the casing cap to the casing.

12 Claims, 6 Drawing Sheets

SUNTAN LOTION APPLICATOR

The present invention relates to devices for applying suntan lotion and more particularly to devices for applying suntan lotion to a user's back and other hard to reach areas of the body.

BACKGROUND OF THE INVENTION

Despite publicity about the dangers associated with excessive sun exposure, people enjoy sun tanning. People with a good tan tend to be considered healthier and more attractive than people with a pale complexion. Fortunately, however, most people are smart enough to realize that if they are going to be spending time in the sun, they should apply some type of suntan lotion. Suntan lotion applicators are known, but a majority of people still apply suntan lotion by squirting the lotion into their hands, and then rubbing it into the skin. Utilizing this old-fashioned method, it is virtually impossible for someone to apply suntan lotion to one's back without assistance. Failure to apply suntan lotion can, of course, result in sunburn.

U.S. Pat. Nos. 5,568,669 and 5,664,281 are two recently issued patents that disclose lotion applicators that attempted to address the problems associated with applying suntan lotion. U.S. Pat. No. 5,568,669 discloses a non-porous pad affixed to a thin retractable handle. Because the disclosed pad is non-porous, it does not adequately absorb lotion and tends to smear the lotion instead of spreading it evenly.

Pat. No. 5,664,281 discloses a porous pad attached to a thin hinged handle. This porous pad is exposed to ambient air, and unless cleaned the lotion in the pad will quickly dry and the pad will become ineffective as an applicator.

In both 5,664,281 and 5,568,669, lotion is poured onto the pad from a separate bottle of suntan lotion. Also, both patents disclose flimsy devices that could easily break if not carefully handled. Similar problems exist with other prior art devices.

What is needed is a new, sturdy suntan lotion applicator that effectively applies suntan lotion to hard to reach areas of the user's body without getting suntan lotion on the user's hands.

SUMMARY OF THE INVENTION

The present invention provides a lotion applicator that has a hollow handle for containing lotion. The hollow handle has a closable opening and flexible walls such that the squeezing of the walls forces lotion contained within the hollow handle to exit the closable opening. A casing is attached to the handle and covers the closable opening. A casing cap is removably attached to the casing such that a storage compartment is formed by the attachment of the casing cap to the casing. A porous pad is contained within the storage compartment and is for absorbing lotion squeezed out of the handle. Some purposes of the casing cap are to delay drying of the pad, protect the pad from contamination, and prevent lotion on the pad from contaminating other objects.

In a preferred embodiment, the user first removes the casing cap from the casing. Then, the user removes the handle from the casing. The user then opens the closable opening and squeezes the handle so that lotion exits the handle and is applied to the pad. The user then reattaches the handle to the casing. Now the user is able to apply lotion to his back and other parts of the body by gripping the handle and rubbing the pad over his body. When complete, the user reattaches the casing cap to the casing.

DETAILED DESCRIPTION OF THE INVENTION

The present invention provides a sturdy, refillable suntan lotion applicator that enables a user to effectively apply suntan lotion to hard to reach areas of his body without getting suntan lotion on his hands. In addition, the user is able to continuously reapply suntan lotion for maximum protection while exposed to the sun.

First Preferred Embodiment

The Handle

Figure 1:
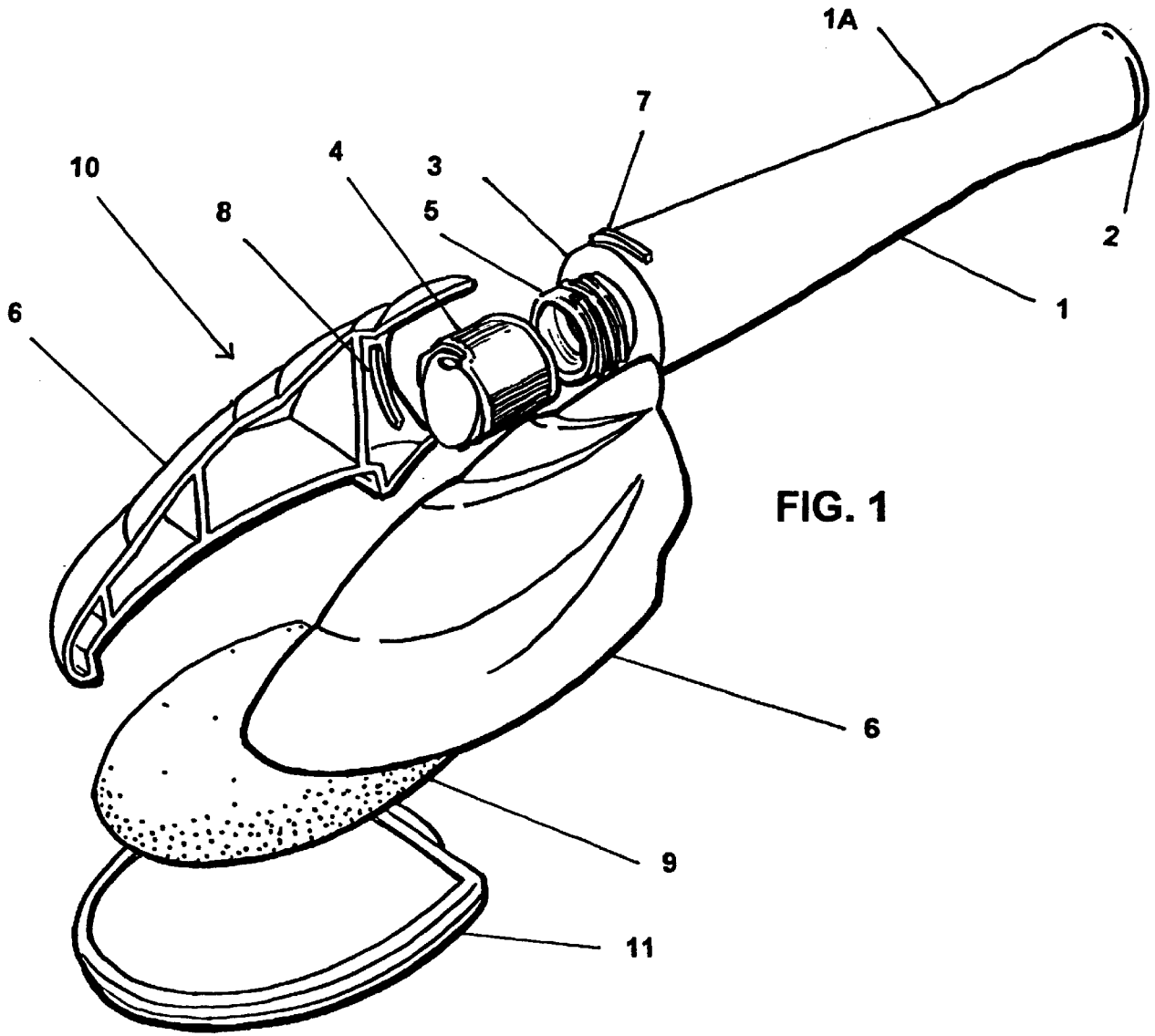
FIG. 1 shows an exploded view of the first preferred embodiment.
Figure 2:
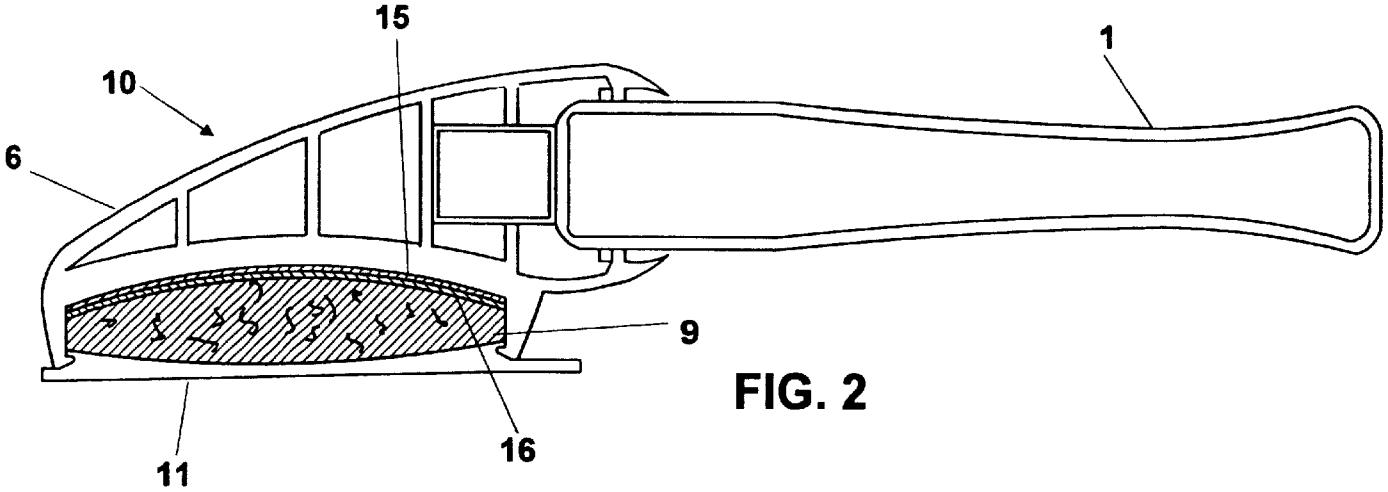
FIGS. 2 and 3 show side views of a first preferred embodiment.
Figure 3:
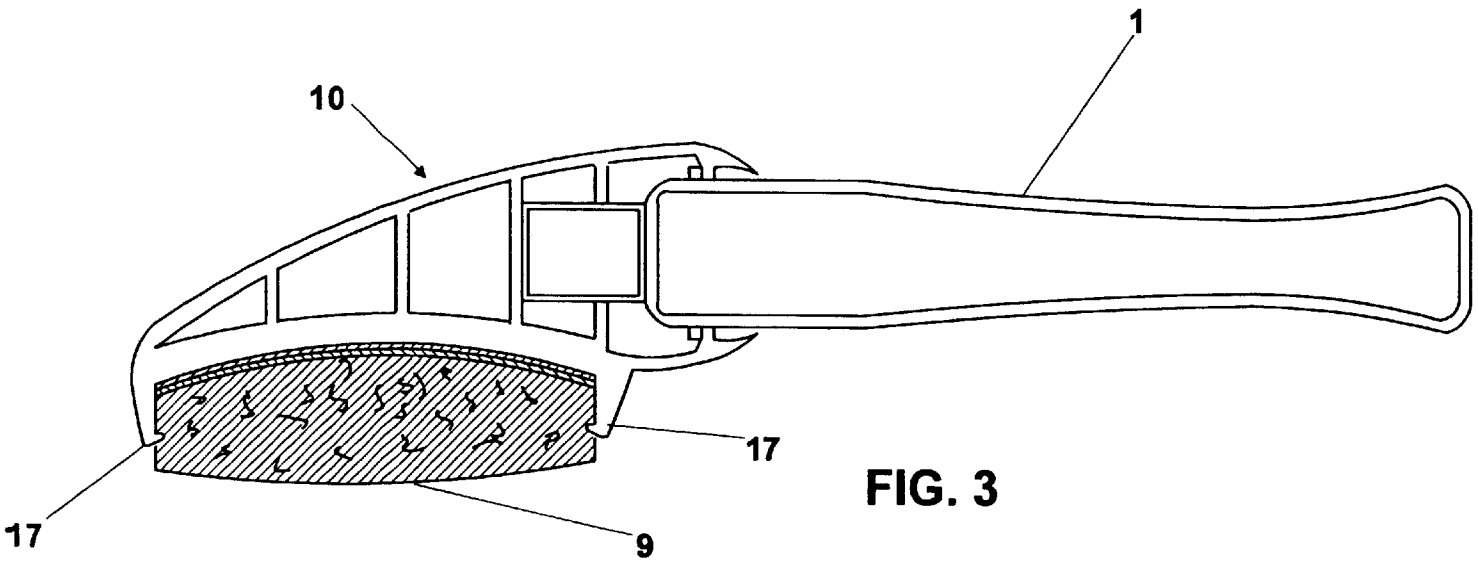

As shown in FIGS. 1–3, Handle 1 is hollow and is closed at non-threaded end 2 and open at threaded end 3. In addition to its function as a handle for applicator 10, handle 1 also functions as a storage container for suntan lotion. Consequently, handle 1 satisfies the following two requirements: (1) it is firm enough to remain substantially straight while applicator 10 is being used to apply suntan lotion, and (2) it is flexible enough so that a user can squeeze it to force out the suntan lotion. To meet these requirements, preferably, handle 1 is fabricated from polypropylene. Also, preferably, handle 1 has a length of approximately 8½ inches. This length is desirable because it enables a user, even one of limited flexibility, to adequately apply lotion to his back.

As seen in FIG. 1, handle 1 has the approximate shape of a hollow cylinder, but is contoured (i.e., the diameter of handle 1 is about 1⅝ inch at threaded end 3 and gradually becomes smaller (i.e. about 1⅛ inch) approximately ⅔ of the way towards the non-threaded end at grip point 1A and then slightly widens again, to about 1 7/16 inch, at non-threaded end 2.) The contoured shape allows a user, particularly one with small hands, to easily grip handle 1 at grip point 1A, while also allowing for greater lotion storage capacity at each end. The generally cylindrical shape also serves to increase the rigidity of handle 1, making it unlikely to bend during operation.

Valve Cap

Valve cap 4 has internal threads that mesh with exterior threads 5 on handle 1. As seen in FIG. 1, valve cap 4 is shown as including a tilt valve. When valve cap 4 is closed and threaded onto threads 5, air is prevented from contacting lotion inside of handle 1, likewise, the lotion inside of handle 1 is prevented from leaving handle 1. However, by opening valve cap 4, and squeezing handle 1, a user is able to force lotion out of handle 1.

The Casing

Preferably, casing 6 is fabricated from ABS plastic. Casing 6 is split into two halves as shown in FIG. 1 which are ultrasonically welded together. In the preferred embodiment, threads 8 and 7 are short and discontinuous as shown in FIG. 1. Threads 7 on handle 1 mesh with threads 8 on casing 6. When attaching or detaching casing 6 from handle 1, a short quarter turn is all that is required to engage or disengage the threads. This quick-release thread feature allows for quick attachment and detachment of the casing.

The Pad

In this preferred embodiment, pad 9 is a porous polyurethane pad. This pad is ideal because it easily absorbs suntan lotion, it is durable so that it can be used repeatedly without ripping or decomposing, and it is relatively smooth so that when rubbed against the skin it is non-abrasive.

FIGS. 2 and 3 illustrate how pad 9 is attached to applicator 10 in the first preferred embodiment. Pad 9 is attached to the underside of casing 6 with Velcro®. Velcro® refers generally to the hook and loop structure that when pressed together provides that two parts carrying the Velcro® are releasably joined. As shown in FIG. 2, Velcro® part 15 is glued to the underside of casing 6 and Velcro® part 16 is glued to the top side of pad 9. Velcro® Parts 15 and 16 are connected together by virtue of their hook and loop structure. Therefore, when casing cap 11 is removed from casing 6, pad 9 remains attached to casing 6 because of Velcro® parts 15 and 16. Attaching pad 9 to casing 6 with Velcro® is a preferred embodiment because it allows for easy removal of pad 9 for cleaning if it becomes dirty or replacement of pad 9 if it becomes worn.

Casing Cap

Casing cap 11 snaps to the underside of casing 6. Preferably, casing cap 11 is fabricated from injection molded thermoplastic rubber. When snapped to the underside of casing 6, casing cap 11 reduces outside air contact with pad 9. This serves to delay the drying out of lotion absorbed into pad 9. Also, casing cap 11 prevents debris from contaminating pad 9 and prevents the lotion on pad 9 from contaminating other objects.

Casing cap 11 also holds pad 9 under compression as illustrated in FIGS. 2 and 3. FIG. 2 shows applicator 10 with casing cap 11 attached. Pad 9 is compressed between casing cap 11 and casing 6. In FIG. 3, casing cap 11 has been removed. Pad 9, no longer under compression, expands so that the bottom side of pad 9 extends below casing tabs 17. It is necessary that the pad extend below casing tabs 17 so that when utilizing applicator 10, pad 9 contacts the skin instead of casing tabs 17 contacting the skin.

Use of the First Preferred Embodiment

To apply lotion to pad 9, first the user unsnaps casing cap 11 from casing 6. Then, the user rotates handle 1, which causes it to unthread from casing 6. The user opens valve cap 4 and squeezes tube 1 so that suntan lotion exits handle 1 and is applied to pad 9. The user then closes valve cap 4. The user then reattaches handle 1 to casing 6. Now the user is able to apply suntan lotion to his back and other parts of the body by gripping handle 1 and rubbing the pad over his body. When the user is finished, snaps casing cap 11 back onto casing 6.

Second Preferred Embodiment

Figure 4:
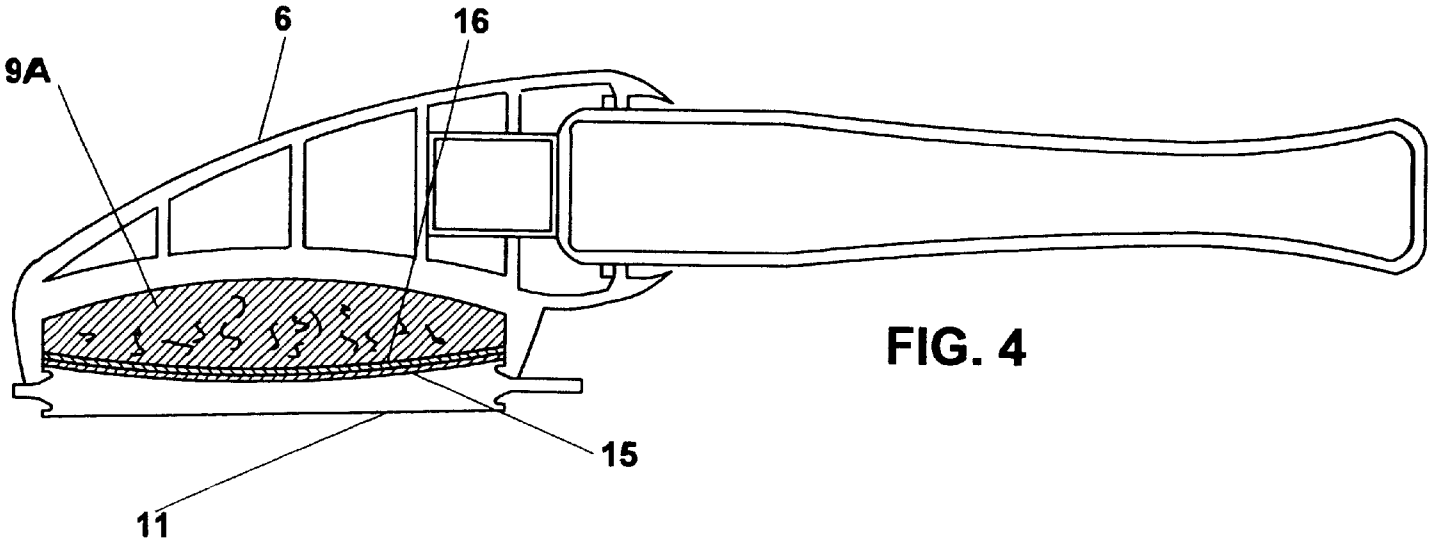
FIGS. 4 and 5 show side views of a second preferred embodiment.
Figure 5:
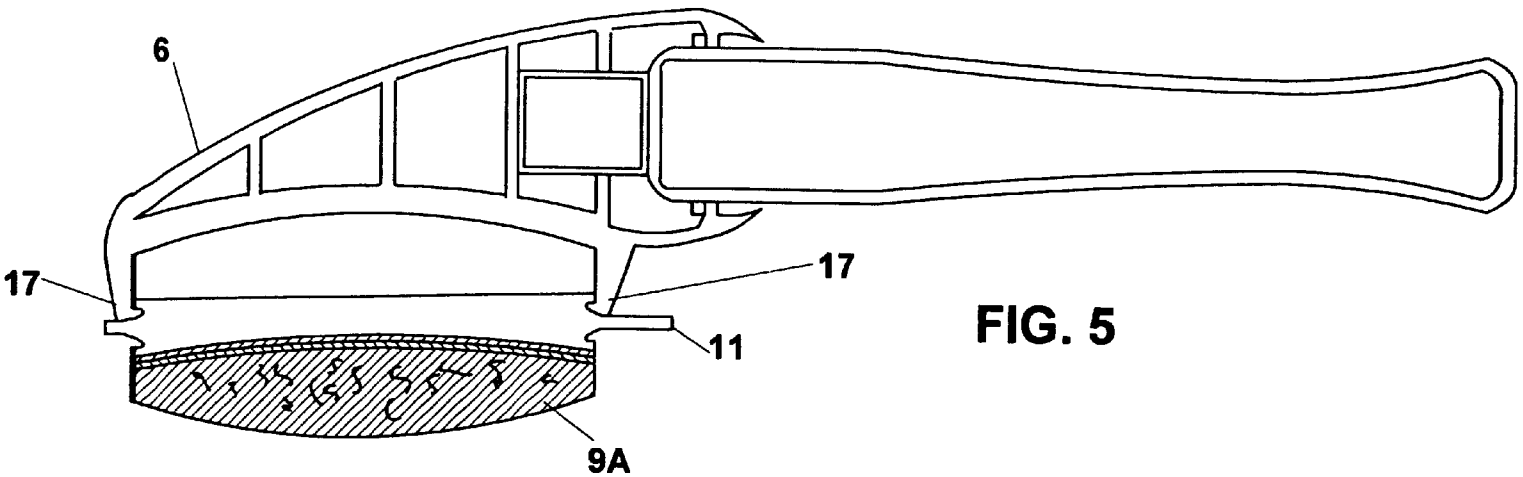

A second preferred embodiment is illustrated in FIGS. 4 and 5. As shown in FIG. 4, Velcro® part 15 is glued to casing cap 11 and Velcro® part 16 is glued to pad 9A. To utilize the second preferred embodiment, casing cap 11 is unsnapped from its position as shown in FIG. 4 and then re-snapped so it is attached to casing 6 as shown in FIG. 5. In the second preferred embodiment, pad 9A can be thinner than pad 9 in the first preferred embodiment since pad 9A does not need to extend beyond tabs 17.

Third Preferred Embodiment

Figure 6:
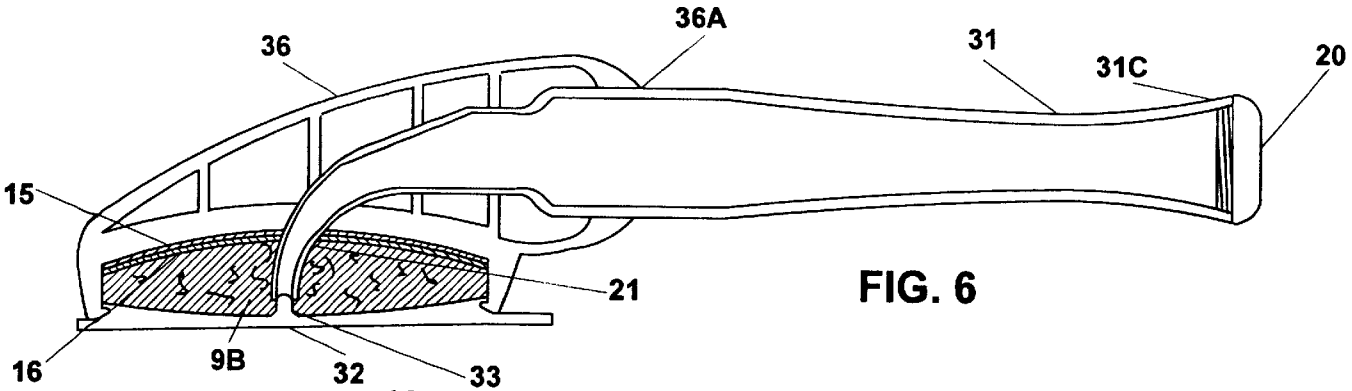
FIGS. 6 and 7 show side views of a third preferred embodiment.

A third preferred embodiment is illustrated in FIG. 6. Handle 31 extends into casing 36 where its diameter gradually decreases to form a nozzle 21. Nozzle 21 extends through a hole in the underside of casing 36, through a hole in Velcro® parts 15 and 16 and through a hole in pad 9B. Casing cap 32 has nozzle plug 33. When casing cap 32 is snapped onto casing 36, nozzle plug 33 covers nozzle 21 so that a substantially airtight seal is formed. This seal prevents suntan lotion contained inside of handle 31 from exiting handle 31 at nozzle 21.

Figure 7:
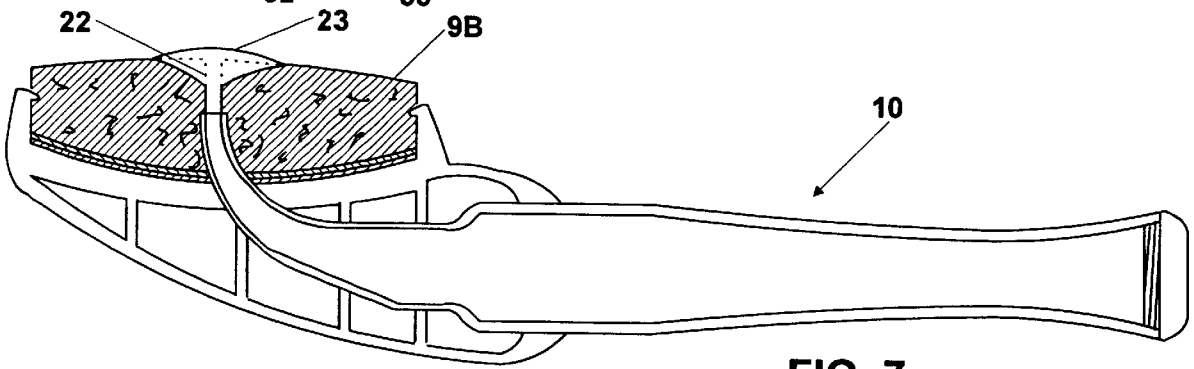

The main advantage of this embodiment is that it is unnecessary to remove handle 31 from casing 36 as described in the previous embodiments. As shown in FIG. 6, casing 36 is rigidly connected to handle 31 at connection 36A. Here, after casing cap 32 is removed, a user merely squeezes handle 31 and lotion is forced through nozzle 21. As the suntan lotion 23 exits nozzle 21, it travels through hole 22 as shown in FIG. 7. Applicator 10 should be held in the upside down position as shown in FIG. 7 to prevent suntan lotion 23 from spilling out onto the floor as handle 31 is squeezed. After a substantial amount of suntan lotion 23 accumulates on pad 9B, the user is ready to rub the lotion into his body. As shown in FIG. 7, as suntan lotion 23 is first squeezed out of handle 31, it will tend to accumulate in the center of pad 9B as a rounded blob, with some of lotion being absorbed by pad 9B. As pad 9B is rubbed across the body, suntan lotion 23 will tend to spread across the top of pad 9B so that there is substantially an even distribution.

As suntan lotion is depleted, more lotion can be added to handle 31 through threaded end 31C. To add lotion, a user will first unthread cap 20. After the lotion has been added, cap 20 needs to be re-threaded onto handle 31.

Other Embodiments

Figure 8:
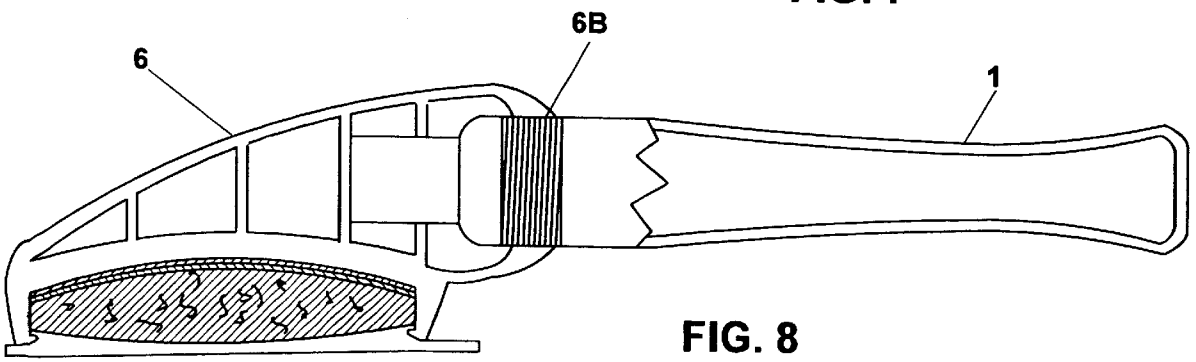
FIG. 8 shows another preferred embodiment.
Figure 9:
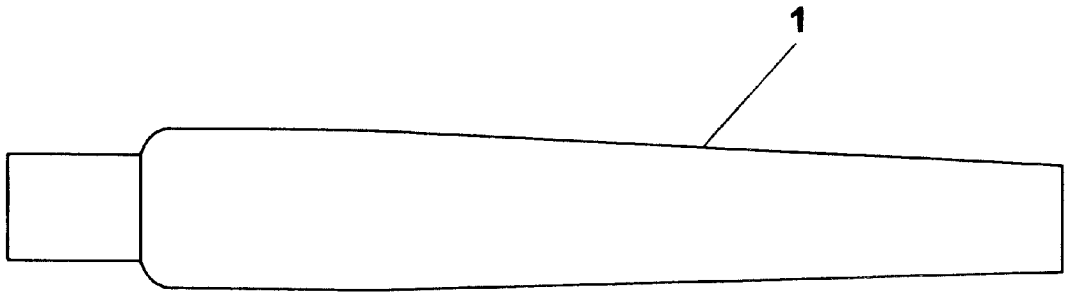
FIG. 9 shows another preferred embodiment.
Figure 10:
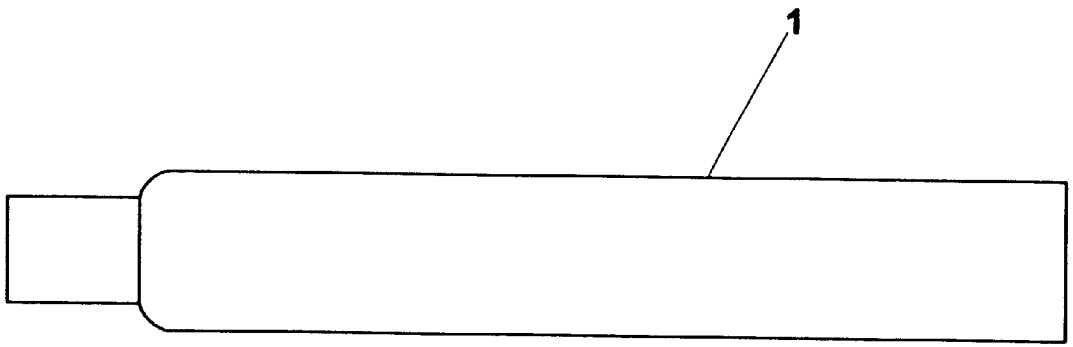
FIG. 10 shows another preferred embodiment.

FIG. 8 depicts another embodiment. This embodiment is similar to the first embodiment, except that casing 6 is not attached to handle 1 with quick-release threads. FIG. 8 shows handle 1 attached to casing 6 with threads 6B. Also, all previous embodiments have described handle 1 as having a contoured shape that is initially wide, narrows, and then widens again. It is also possible to have a handle 1 that is contoured so that it only narrows (as shown in FIG. 9) or a handle 1 that remains substantially the same width (as shown in FIG. 10).

In previous embodiments, valve cap 4 was described as being a tilt valve. However, many other types of valves could also be used. For example, a push-pull valve or a twist valve could be used as well.

Figure 11:
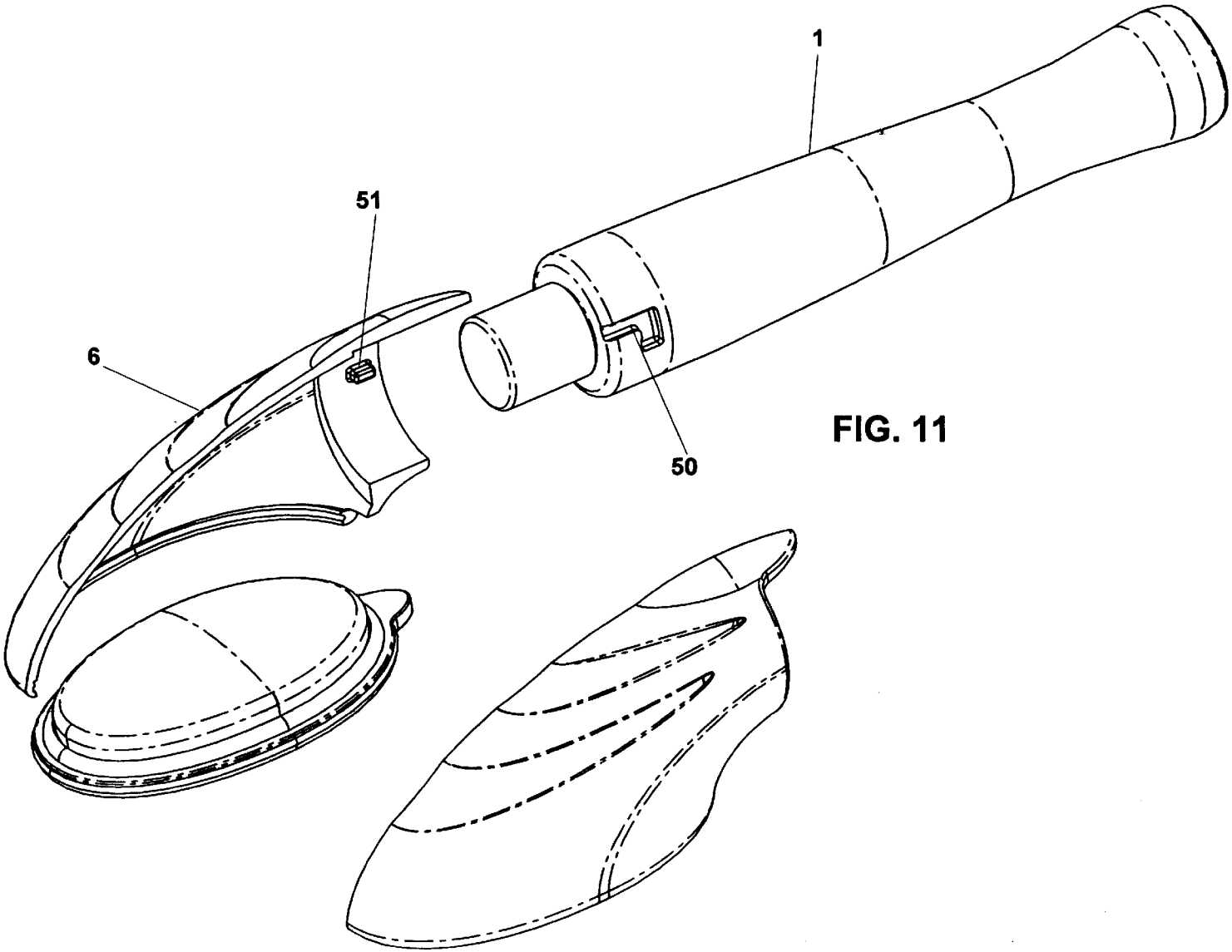
FIG. 11 shows another preferred embodiment.

FIG. 11 shows an embodiment that utilizes another type of a quick-release device connecting handle 1 to casing 6. Two L-shaped slots 50 are on opposite sides of handle 1. Two tabs 51 are on opposite sides of casing 6. Handle 1 is joined to casing 6 by aligning slots 50 with tabs 51 and twisting handle 1 clockwise relative to casing 6. Likewise, handle 1 is separated from casing 6 by twisting handle 1 counterclockwise and then pulling handle 1 away from casing 6 so that tabs 51 slide through slots 50.

Other Modifications

In previous embodiments, casing cap 11 was shown as being snapped onto casing 6. However, casing cap 11 can also be threaded onto casing 6. Pad 9 was shown as being attached to lotion applicator 10 by Velcro®. However, it is also possible to pad 9 onto either casing 6 or casing cap 11 by other means, such as gluing. In the previous embodiments, valve cap 4 was shown as being threaded onto handle 1. However, it is possible to attach valve cap 4 to handle 1 in other ways, such as by snapping or gluing it. In all previous embodiments, discussion has focused on using lotion applicator 10 for suntan lotion. However, it is also possible to use other types of lotion with lotion applicator 10, such as liquid soap for shower use, insect repellant, baby lotion, liquid medicine for skin treatment, and their equivalents. Also, although previous embodiments have focused on using applicator 10 for applying lotion to humans, it is also possible to use applicator 10 for other purposes, such as applying lotion to a car, a pet or similar objects.

While the above description contains many specifications, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents, and not by the examples which have been given.

What is claimed is:

1. A lotion applicator for applying lotion to the skin of a person including all parts of the person's back, said applicator comprising:

A) a casing,

B) a body lotion containing handle at least 8½ inches long removably attached to said casing, said handle comprising:

1) body lotion, 2) a closable opening, and 3) a flexible wall which when squeezed forces portions of said body lotion out of said opening, said casing adapted to enclose said opening when said handle is attached, C) a removable casing cap, D) an absorbing pad attached to said casing cap, wherein said cap is configured to be attachable to said casing to form a sealed chamber with said pad within said sealed chamber when said applicator is not in use and to be attachable with said pad external to said chamber when said applicator is being used.

2. A lotion applicator as in claim, 1, wherein said handle is a contoured handle.

3. A lotion applicator as in claim 1, wherein said handle is a hollow cylinder.

4. A lotion applicator as in claim 1, wherein said closable opening is a valve.

5. A lotion applicator as in claim 4, wherein said valve comprises threads and is threaded onto said handle.

6. A lotion applicator as in claim 4, wherein said valve comprises a snap attachment and is snapped onto said handle.

7. A lotion applicator as in claim 4, wherein said valve is a tilt valve.

8. A lotion applicator as in claim 1, wherein said casing comprises threads and is threaded onto said handle.

9. A lotion applicator as in claim 8, wherein said threads are quick release threads.

10. A lotion applicator as in claim 1, wherein said casing cap comprises a snap attachment and is snapped onto said casing.

11. A lotion applicator as in claim 1, wherein said absorbing pad is connected to said, casing cap via a hook and loop fastener connection.

12. A lotion applicator for applying lotion to the skin of a person including all parts of the person's back, said applicator comprising:

A) a casing,

B) a body lotion containing handle at least 8½ inches long removably attached to said casing, said handle comprising:

1) body lotion, 2) a closable opening, and 3) a flexible wall which when squeezed forces portions of said body lotion out of said opening, said casing adapted to enclose said closable opening when said handle is attached;

C) an absorbing pad attached to said casing,

D) a removable casing cap configured to form with said casing a sealed pad storage compartment for said pad when said handle is attached to said casing, wherein said handle and said casing cap must be removed from said casing in order to apply body lotion to said pad whereafter said handle is reattached to said casing for application of said body lotion to said person's skin.

* * * * *